US005366393A

United States Patent [19]

Uenage et al.

[11] Patent Number: 5,366,393

[45] Date of Patent: Nov. 22, 1994

[54] AUTOMATIC TRIM CONTROLLER FOR MARINE PROPULSION UNIT

[75] Inventors: Toshihiko Uenage; Yoshihide Hirano, both of Hamamatsu, Japan

[73] Assignee: Sanshin Kogyo Kabushuiki Kaisha, Hamamatsu, Japan

[21] Appl. No.: 979,407

[22] Filed: Nov. 19, 1992

Related U.S. Application Data

[63] Continuation of Ser. No. 847,486, Apr. 3, 1986, abandoned.

[30] Foreign Application Priority Data

Apr. 4, 1985 [JP] Japan ..... 60-70041

[51] Int. Cl.[5] ..... B63H 21/22

[52] U.S. Cl. ..... 440/1; 440/61

[58] Field of Search ..... 440/1, 2, 900, 88, 50, 440/53, 59, 6, 84, 87, 113; 364/424, 442; 73/178 T; 416/27; 318/558; 244/182, 191, 194; 114/275, 278, 282

[56] References Cited

U.S. PATENT DOCUMENTS

| | | | |
|---|---|---|---|
| 2,610,602 | 9/1952 | Schenavar | 440/88 |
| 3,070,301 | 12/1962 | Sarnoff | 364/442 |
| 3,191,573 | 6/1965 | Hixon | 440/59 |
| 3,314,391 | 4/1967 | Dupont | 440/1 |
| 3,468,282 | 9/1969 | Wintercorn | 440/1 |
| 3,641,965 | 2/1972 | Schmiedel | 440/2 |
| 3,714,825 | 2/1973 | Melvin | 73/178 T |
| 4,318,699 | 3/1982 | Wenstadt et al. | 440/1 |
| 4,368,509 | 1/1983 | Li | 364/442 |
| 4,413,215 | 11/1983 | Cavil et al. | 318/588 |
| 4,718,872 | 1/1988 | Olson et al. | 440/53 |

*Primary Examiner*—Edwin L. Swinehart

*Attorney, Agent, or Firm*—Knobbe, Martens, Olson & Bear

[57] ABSTRACT

Several embodiments of automatic trim controls for marine outboard drives for maintaining the optimum trim angle under all running conditions. The velocity of the watercraft is determined and the outboard drive is trimmed up as long as the velocity continues to increase and then is trimmed down so as to maintain the highest velocity possible for a given running condition. Several different computer programs are illustrated and described for achieving this purpose and a number of different embodiments of power units for controlling the trim condition are also described, some hydraulic and other mechanical.

10 Claims, 8 Drawing Sheets

Fig-7
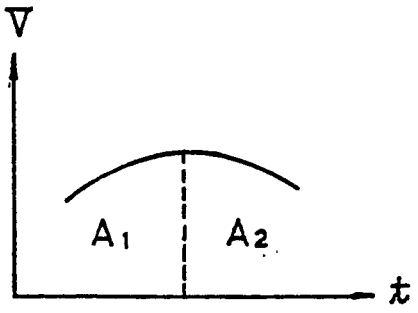
Fig-8
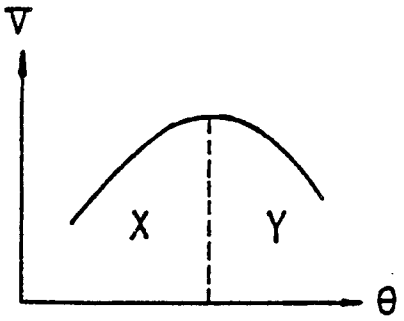
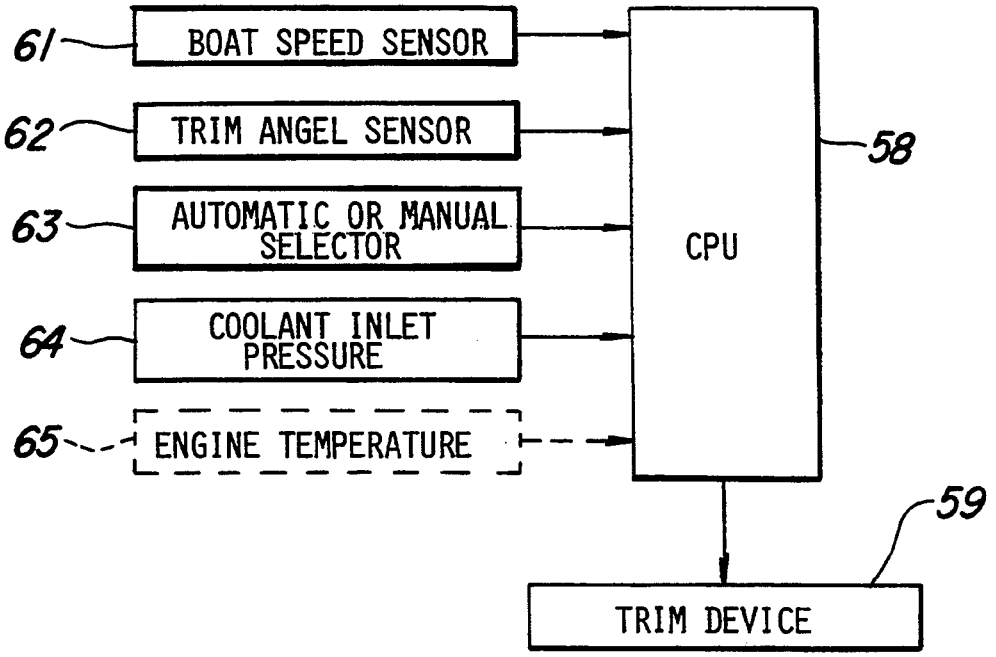
Fig-9

AUTOMATIC TRIM CONTROLLER FOR MARINE PROPULSION UNIT

This is a continuation of U.S. patent application Ser. No. 847,486, filed Apr. 3, 1986, now abandoned.

BACKGROUND OF THE INVENTION

This invention relates to an automatic trim controller for a marine propulsion unit and more particularly to an improved trim controller that will provide the proper trim control for all conditions.

In substantially all marine propulsion systems, the optimum trim angle of the propelling unit relative to the hull of the watercraft varies with a number of conditions. As a general rule, when the watercraft is being accelerated from standstill, the optimum trim angle is a trim down angle wherein the propulsion unit has a maximum degree of submersion. However, as the watercraft reaches crusing speeds, the optimum trim angle is substantially less. In addition to speed, such factors as the weight in the watercraft and a variety of other conditions affect the optimum trim angle. It has been proposed to provide devices which permit the operator of the watercraft to adjust the trim angle of the propulsion unit during running of the watercraft. In addition, automatic trim sensing devices have been proposed wherein the trim angle of the propulsion unit will be varied to suit running conditions. However, those systems which have been proposed for automatic control generally are programmed to operate in response to only one predetermined condition, normally either watercraft or engine speed and, hence, are not truly sensitive to all conditions so as to set the optimum trim angle.

It is, therefore, a principal object of this invention to provide an arrangement for automatically trimming a marine propulsion unit that is responsive to all conditions.

It is a further object of this invention to provide a method for trimming an outboard motor that will provide the optimum trim angle under all running conditions.

SUMMARY OF THE INVENTION

A first feature of this invention is adapted to be embodied in a watercraft that comprises a hull, a propulsion unit that is adapted to be submerged in the water for propelling the hull and means for mounting the propulsion unit on the hull for pivotal movement about a generally horizontal trim axis for adjusting the trim angle of the propulsion unit. Power means are provided for pivoting the propulsion unit about the trim axis for adjusting the propulsion unit trim angle. In accordance with this feature of the invention, means are provided for controlling the power means to maintain the appropriate trim angle for all running conditions comprising sensing means for sensing the change of velocity and means for operating the power means for adjusting the trim angle in response to sensed changes in velocity.

A further feature of the invention is adapted to be embodied in a method for trimming the propulsion unit of a watercraft of the type described in the preceding paragraph. In accordance with this method, the change in velocity with time is computed and the trim angle is adjusted so as to maintain the optimum trim angle for all running conditions.

BRIEF DESCRIPTION OF THE DRAWINGS

FIG. 7 is a graphical view showing velocity with respect to time during a trim cycle.

FIG. 8 is a graphical view showing trim angle versus velocity under a constant power setting.

FIG. 9 is a schematic view showing another embodiment of the invention.

DETAILED DESCRIPTION OF THE PREFERRED EMBODIMENT

Figure 1:
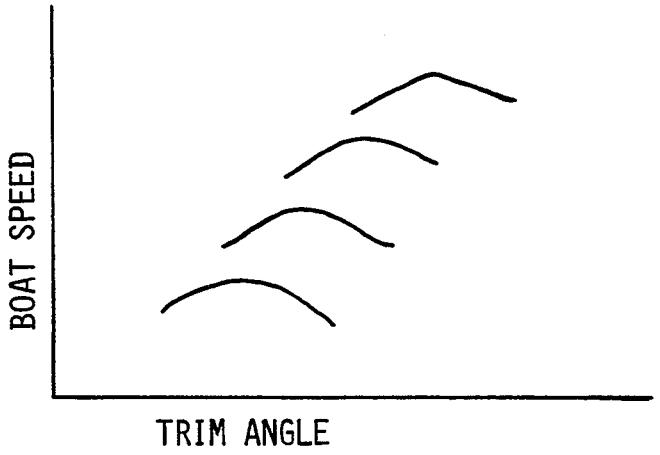
FIG. 1 is a graphical view showing how the optimum trim angle varies with watercraft speed and other conditions.

The principle of the invention may be best understood by reference to FIG. 1 wherein ship speed in relation to trim angle is plotted for a number of fixed engine power outputs. It will be seen that at a given power output $P_1$, $P_2$, $P_3$, $P_{max}$, that the speed of the watercraft will increase as the trim angle increases up to a maximum and then the speed again decreases. Hence, for each power setting, there is an optimum trim angle to insure the maximum velocity of the associated watercraft. Of course, the individual curves will vary from watercraft to watercraft and similar curves would be generated for varying loading of the same watercraft. Therefore, it is the principal object of this invention to provide an arrangement for adjusting the trim condition so as to provide the optimum running and maximum speed at a given pour setting and for a given watercraft loading.

Figure 2:
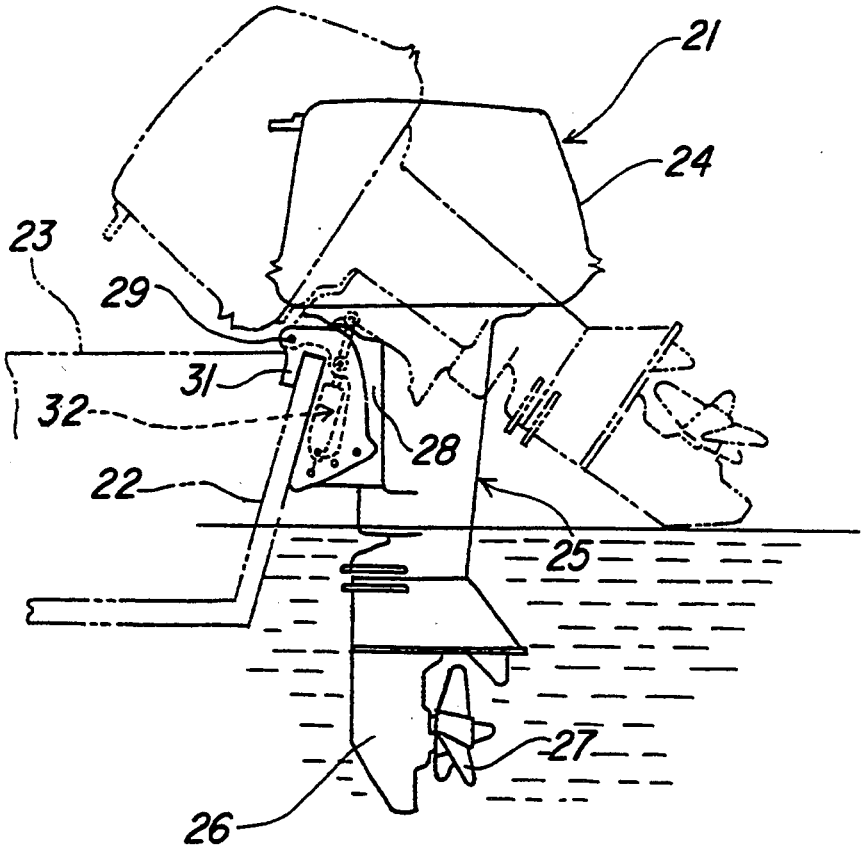
FIG. 2 i s a side elevational view of a watercraft and propulsion unit constructed in accordance with an embodiment of the invention.

Referring now to FIG. 2, a typical environment in which the invention may be practiced is illustrated. An outboard motor, indicated generally by the reference numeral 21, is associated with a transom 22 of a watercraft 23. The outboard motor 21 includes a power head 24 comprised of an internal combustion engine and a surrounding protective cowling, a drive shaft housing 25 in which a drive shaft driven by the engine of the power head is journaled and a lower unit 26 containing a final drive for driving a propulsion device such as a propeller 27. It is to be understood that although the invention is described in conjunction with an outboard motor and one having a propeller, that the invention may be practiced with the outboard drive portion of an inboard/outboard drive and may also be practiced with other types of propulsion systems than those using propellers.

A steering shaft (not shown) is affixed to the drive shaft housing 25 and journaled for steering movement about a vertically extending steering axis by means of a swivel housing 28. The swivel housing 28 is, in turn, supported for tilting movement about a generally horizontally extending axis by means of a tilt pin 29 which is, in turn, carried by a clamping bracket 31. The clamping bracket 31 includes a structure for attaching it to the watercraft transom 22, as is well known in this art.

Figure 3:
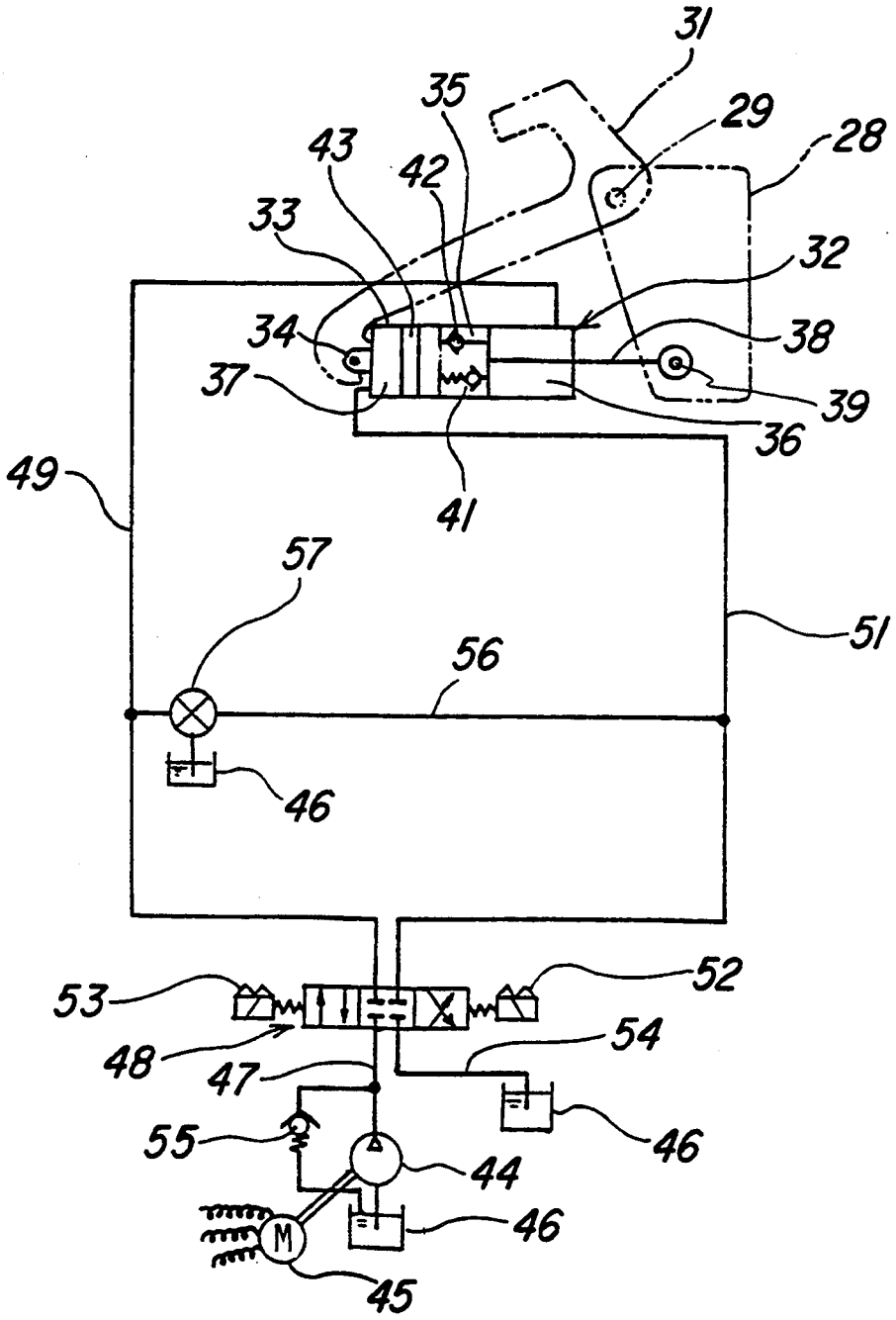
FIG. 3 is a partially schematic view showing an embodiment of power unit for adjusting the trim position.

A combined fluid motor and shock absorber assembly, indicated generally by the reference numeral 32, and shown in most detail in FIG. 3, is provided for controlling the tilting and trim movement of the outboard motor 21 about the tilt axis 29.

Referring now primarily to FIG. 3, the fluid motor 32 is comprised of an outer cylinder assembly 33 which carries a trunnion at one end for pivotal connection by means of a pivot pin 34 to the clamping bracket 31. A piston 35 is slidably supported within the cylinder 33 and divides it into an upper chamber 36 and a lower chamber 37. A piston rod 38 is affixed to the piston 35 and has a trunnion which accommodates a pivot pin 39 for pivotal connection to the swivel bracket 28. It should be readily apparent that the axial movement of the piston 35 within the cylinder 34 will control the angular position of the outboard motor 21 about the tilt pin 29.

A passage including a pressure responsive shock absorber valve 41 extends through the piston 35 for permitting flow from the upper chamber 36 to the lower chamber 37 when an underwater obstacle is struck so the motor 21 may pop up to avoid damage. Return flow is permitted when the obstacle is cleared through a relief passage 42 that contains a relief valve which opens at a lower pressure than the absorber valve 41.

A floating piston 43 is contained within the lower chamber 37 and divides it into first and second parts. The piston 35 normally is abuttingly engaged with the floating piston 43 for fixing the trim or tilt position of the outboard motor 21.

A hydraulic arrangement is provided for selectively pressurizing either the lower part of the chamber 37 or the upper chamber 36 for adjusting the tilt and trim condition of the outboard motor 21. This arrangement includes a fluid pump 44 that is driven by an electrical motor 45. The pump 44 draws liquid from a reservoir 46 and delivers it to a pressure line 47. A three position, two-way valve, indicated generally by the reference numeral 48 is provided in the line 47 for selectively controlling the delivery of fluid to a first line 49 that extends to the upper chamber 36 and a second line 51 that extends to the portion of the lower chamber 37 below the floating piston 43. The valve 48 is actuated by means of a pair of oppositely acting electrical solenoids 52 and 53. In addition, the valve 48 controls flow back to the reservoir 46 through a return line 54.

The pressure relief valve 55 is provided in the [pump output line 47 for permitting pressure relief when the pistons 43 and 35 are at either extreme ends of their stroke or if the system should bind for some other reason.

Trimming up operation is achieved by energizing the solenoid 53 so that the spool of the valve 48 is shifted to the left as seen in FIG. 3 wherein the line 51 is pressurized and the line 49 acts as a return line. Under this condition, the pistons 43 and 35 will be urged upwardly so as to pivot or tilt the outboard motor 21 in an upward direction. If the solenoid 52 is energized, on the other hand, the valve spool will be slid to the right as seen in FIG. 3 and the line 49 becomes the pressure line and the line 51 becomes the return line. Trimming down operation will then result.

In order to permit manual control or tilting of the outboard motor 21 without restriction from the hydraulic circuit, there is provided a bypass line 56 that extends between the lines 49 and 51 for direct communication. A manually operated valve 57 is provided in this line 56 and is connected to the reservoir 46 so as to permit makeup fluid to be drawn into the system during manual tilt or trim operation.

The system as thus far described may be considered to be conventional. The invention relates to the manner in which the electric motor 45 and pump 44 are energized so as to achieve automatic trim control. For this reason, further details of the hydraulic circuit are not given and it is to be understood that any known type of power device may be employed for achieving the tilt and trim movement per se. Several other embodiments of devices for achieving this purpose will be described later.

Figure 4:
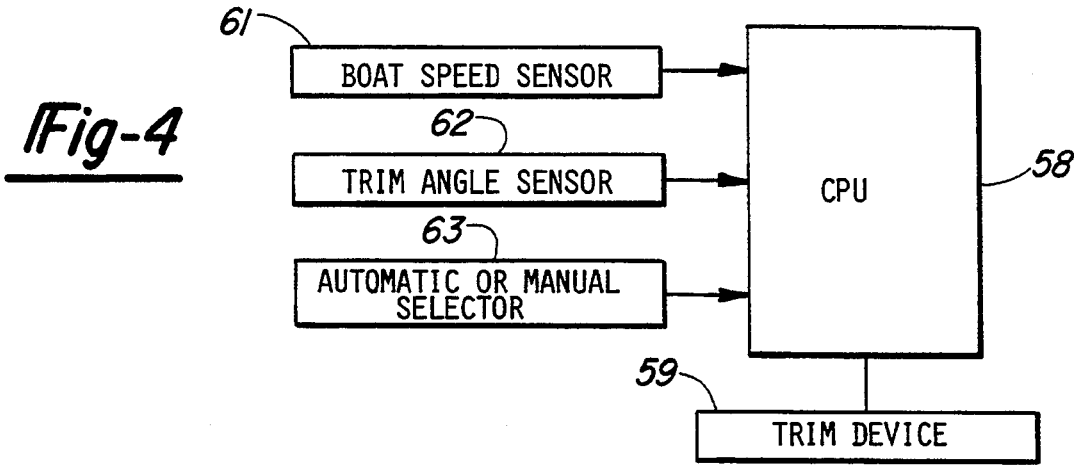
FIG. 4 is a schematic view showing the components of an automatic trim adjuster constructed in accordance with an embodiment of the invention.
Figure 5:
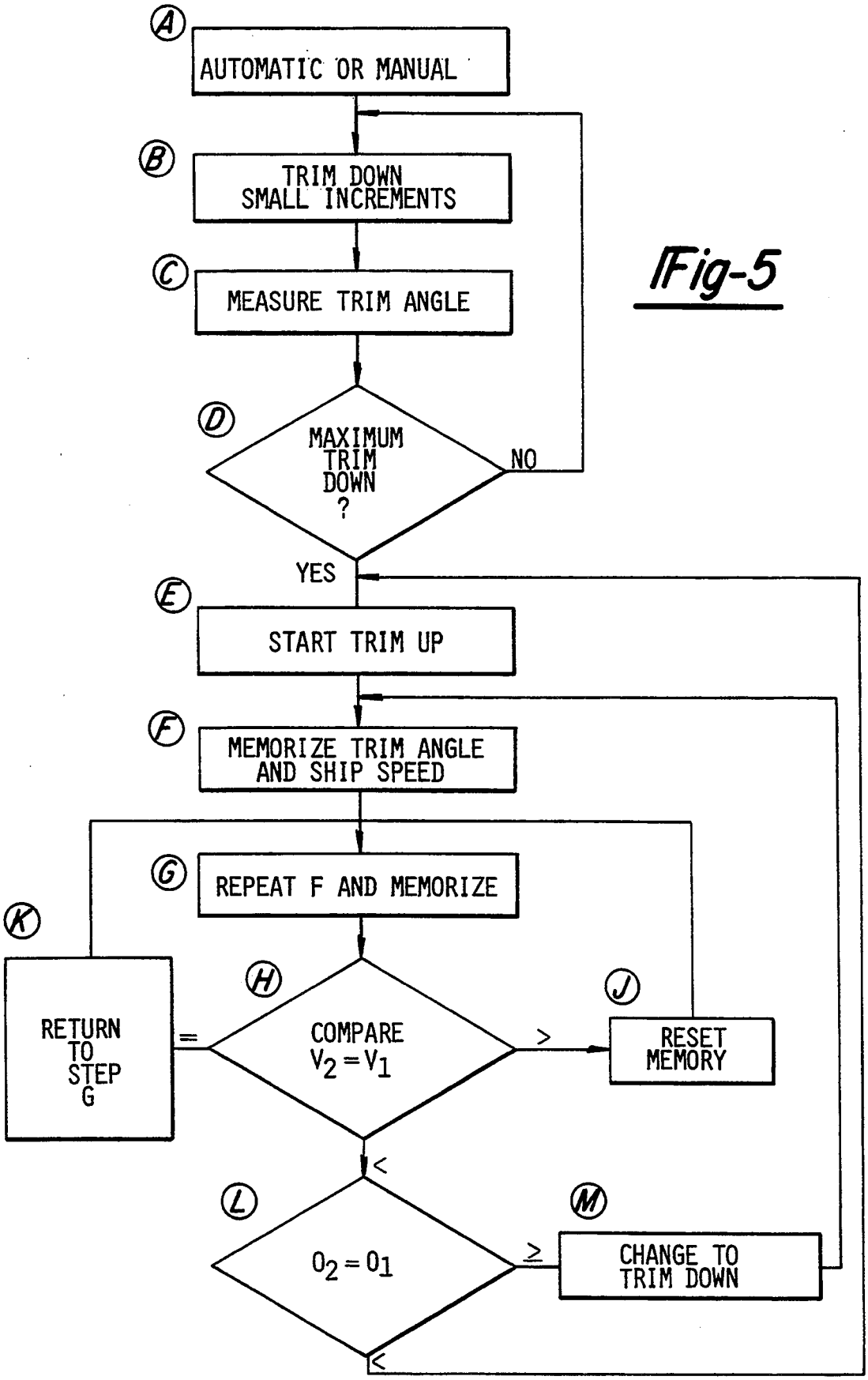
FIG. 5 is a block diagram showing the logic associated with an embodiment of the invention.

Referring now to FIGS. 4 and 5, a control device constructed in accordance with a first embodiment of the invention is illustrated and described. Basically, it is the purpose of the control device to energize the power unit of the tilt and trim mechanism so as to maintain the optimum trim angle for the propulsion unit under any given running condition. This is accomplished by continually monitoring the rate of change of speed of the watercraft 23 so as to determine if the watercraft is either accelerating, decelerating or maintaining a set speed. If the watercraft continues to accelerate, the outboard motor will be trimmed up and if the watercraft is decelerating, the outboard will be trimmed down. Under steady state condition, there will be no trimming operation.

Referring first to FIG. 4, the device is provided with a central processing unit (CPU) in the form of a computer which is identified generally by the reference numeral 58. The computer 58 sends control signals to the tilt and trim unit, which is schematically indicated at 59, and which may comprise the control circuit for the electric motor 45 in an arrangement of the type shown in FIG. 3. The computer 58 receives input signals from a watercraft speed sensor 61 and a trim angle sensor 62. In addition, there is provided an operator control 63 whereby the watercraft operator may select either manual or automatic trim control.

The logic by which the computer 58 operates may be understood by the block diagram in FIG. 5. In the first step A, the computer 58 determines whether the device is in an automatic mode or a manual mode. If the device is in the manual mode, the remainder of the sequence is not energized and the computer will operate the tilt and trim unit 32 only in response to manual operator control so as to provide for manual tilt or trim up or down.

If, however, the device is in automatic mode, the computer 58 will advance to the step B wherein the trim device 59 is operated to trim down in a small increment. The amount of incremental trim down adjustment is measured by the trim angle sensor 62 at the step C and a determination will be made at step D whether or not the device is in its maximum trim down condition. If it is not, the steps B, C and D will be repeated until the outboard motor 21 is trimmed down to the maximum extent.

Once the outboard motor is trimmed down to its maximum extent, the computer 58 moves to the step E wherein the trim device 59 is acutated to begin a gradual trim up condition. When the trimming up is initiated, the computer moves to step F wherein trim angle and watercraft speed are sensed by the sensors 62 and 61 and are memorized.

The computer then waits for a predetermined time interval, which is chosen to be relatively small, and then moves to step G wherein the watercraft speed and trim angle are again sensed and, memorized by the sensors 61 and 62.

The computer 58 then performs a comparing function indicated by the block H to compare the watercraft speed sensed at the point F and compare it with the watercraft speed at the point G. This makes a determination whether or not the watercraft is accelerating, decelerating or maintaining a constant speed. If it is determined at the step H that the watercraft speed is increasing, then it is discriminated that the watercraft is operating to the lefthand side of the peak of the speed trim angle curve as seen in FIGS. 1 and 7 and the computer moves to step J wherein the memory at step F is reset to the trim angle and watercraft speed indications from step G and the new trim angle and watercraft speed are again sensed and recorded at step G so as to insert new speed and trim angle readings.

If it is determined that the speed of the watercraft has not increased from the point F to the point G, then the computer moves to the step K and substitutes the new trim angle position of the step G for the previous trim angle position at the step F, discontinues the operation of the trim up control through the control device 59 and again measures the velocity and trim angle at the step G.

If at the step H the computer determines that the velocity of the watercraft at the step G was less than the velocity at the step F, it is determined that the trim angle has passed the optimum trim angle and the device is operating at the righthand side of the curves shown in FIGS. 1 and 7 from their maximum. The device then sends this determinative signal to the point L and initiates at the point M a reversal in the direction of trimming mode so that the trim up operation at the step E is discontinued and trim down is then initiated at this step. The device then continues to operate through the steps E, F, G and H only now in trim down rather than trim up mode.

Figure 6:
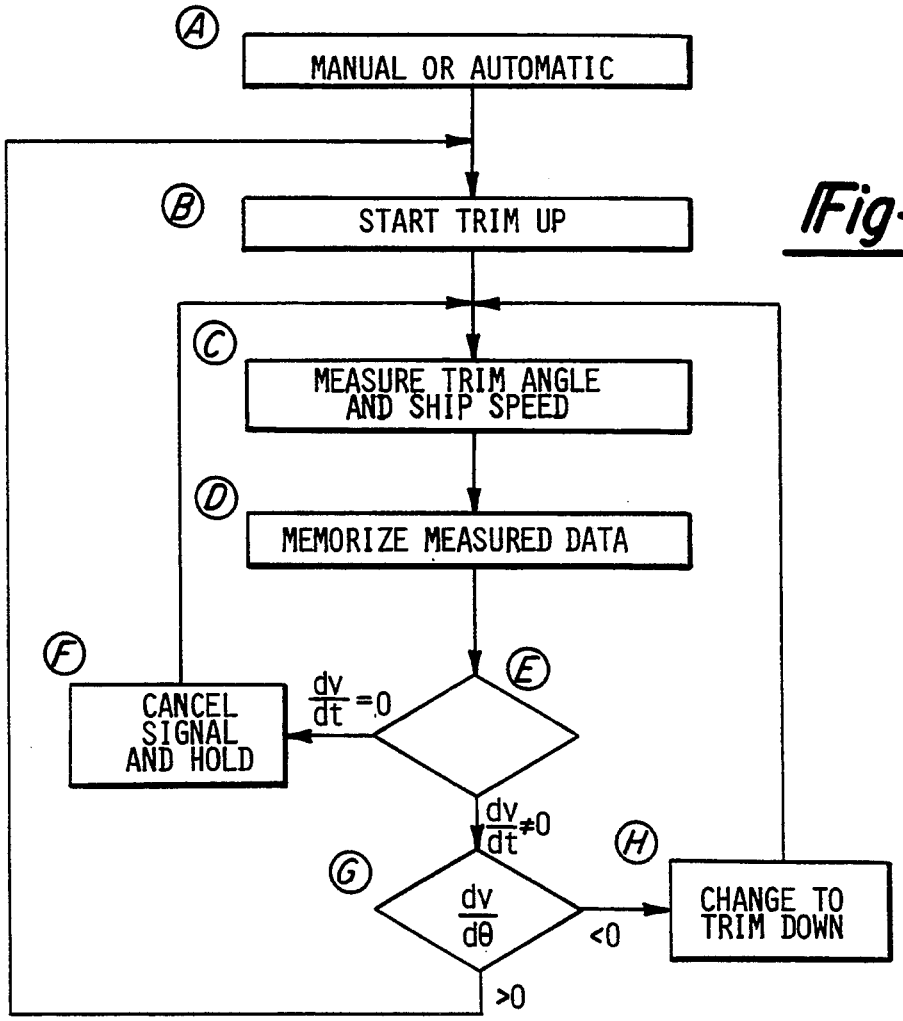
FIG. 6 is a block diagram, in part similar to FIG. 5, showing another embodiment of the invention.

FIG. 6 illustrates another program that may be employed with the computer 58 of FIG. 4. This program is particularly adapted for use with digital computers and includes a first step A in which the computer determines whether the device is operating in manual or automatic mode. If the operation is in manual mode, the computer does nothing further then transmit the operator initiated controlled signals to the trim device 59. If, however, the device is in automatic mode, it proceeds to step B wherein the device 59 is actuated so as to initiate trim up control. Once trim up has been initiated, the computer proceeds to step C wherein the boat speed and trim angle are measured by the sensors 61 and 62 and these measured signals are then memorized at the step D. The computer then performs a differentiating function in accordance with its own analog circuit at step D to determine the change in velocity (dv) in relation to time (dt).

If it is determined that the change in velocity with time is zero, then the computer, at step F, generates a cancel signal so as to hold the trim adjustment where it is.

If, on the other hand, the differentiation results in a value other than zero, the computer determines at step G if the change in velocity with respect to time is either positive (acceleration) or negative (deceleration). If a positive value exists indicating that the boat is still accelerating, the device moves back to and repeats steps B, C, D and E. If, on the other hand, it is determined that the boat is decelerating having passed the peak of the velocity to trim angle curves on FIG. 1 or 8, the device goes from block G to block H so as to reverse the control of the trim device 59 so as to begin trim down operation. Steps C, D and E are then repeated.

FIG. 7 shows the curve of ship speed versus time and indicates when the acceleration peak is passed and deceleration begins. In accordance with the embodiment of FIG. 6, this is when trim down operation begins as shown by the dotted line.

FIG. 8 is a curve in part similar to the curve of FIG. 1 and shows the relationship of velocity to trim angle. Again, when the device is operating on the left side of the dotted line X, the trim up operation should be continued while when it is operating at the right hand side in the area Y, trim down should be initiated.

FIG. 9 shows another embodiment of the invention wherein the CPU 58, which controls the trim device 59, receives in addition to the boat speed signal from the speed sensor 61 and trim angle position from the trim angle sensor 62 additional inputs. There also is provided the manual or automatic selector 63. In this embodiment, there is also provided a signal indicative of coolant inlet water pressure by the sensor 64 and also, if desired, engine temperature as provided by the sensor 65. This embodiment operates so as to insure that the trim angle of the outboard motor or outboard drive is such that it will not adversely affect the intake of cooling water for the associated engine. It should be noted that in some outboard arrangements, the cooling inlet water is delivered through the lower unit and the trim angle position can adversely affect the water pressure at this inlet and, accordingly, the cooling of the associated engine. This embodiment avoids such conditions as will become apparent.

The programming of the computer 58 in this embodiment follows certain of the steps of the embodiment of FIG. 6 and where those steps are the same, they have been identified by the same reference character. The program is again initiated at step A wherein the computer 58 determines if the control 63 is set for either automatic or manual operation. If the device is set for manual operation, the computer 58 only transmits control signals from the operator to the trim device 59.

If, however, the computer control 63 is set in the automatic mode, the pressure of the water at the inlet to the cooling system and trim angle are sensed by the sensors 64 and 62, respectively, at the step J and these values are memorized at the step K. The pressure of the water at the cooling system inlet is then compared at the step L with a preset minimum value A to determine if sufficient cooling water is available. As previously noted, if the outboard unit is trimmed up too much, the pressure of the cooling water inlet will be too low.

If it is determined that the coolant inlet pressure is greater than or equal to the preset minimum pressure A, the computer then moves to step B wherein the trim up operation is initiated as the corresponding step in the embodiment of FIG. 6. The trim angle speed and cooling water inlet pressure are then measured at the step C and memorized at the step D. This is similar to the corresponding steps of the embodiment of FIG. 6, however, the coolant inlet pressure is also measured.

A further determination is then made at the step M to insure that the coolant pressure at the inlet is still greater than the minimum desired pressure A. This is done to insure that the initial trimming up has not caused the coolant inlet pressure to drop to a dangerous level.

If the coolant pressure is still sufficient, the computer moves to the differentiating step E wherein the change in velocity (dv) with respect to change in time is computed. If there is no change in velocity with respect to time (dt), the computer moves at step F to cancel the signal causing trimming up of the outboard motor and to hold it in position.

If, however, the differentiating function results in a value other than zero, the device moves to the step G to determine if acceleration or deceleration is present. If there is acceleration, the computer returns to the step B so as to continue trimming up operation. If, however, it is determined that there is deceleration, then the computer moves to the step H so as to change the signal transmitted back to the trim device 59 so as to initiate trimming down operation beginning at the step C.

Considering now the situation when the coolant pressure is determined to be at below normal at the step L, the computer moves to the step N to generate a signal to begin trimming down operation. It will be remembered that the condition that requires this indicates that the inlet pressure to the coolant system is low and indicates that the outboard drive is trimmed up too greatly. When trimming down is begin at the step N, there is made at the step O a determination of the trim angle as sensed by the trim angle sensors 62 so as to see if the outboard drive is in its fully trimmed down condition. If it is, the device moves to the step P which is an indication that the trouble with the cooling system is other than the trim angle of the outboard drive. There is there initiated a protective signal at the block Q for slowing down the engine speed to insure against overheating. If there is incorporated an engine temperature sensor, this sensor can, through the computer 58, delay the slowdown operation at the step Q until the engine temperature exceeds a predetermined temperature.

If at the stop O it is noted that the outboard motor is not in its fully trimmed down condition, then the computer moves to the step R wherein the pressure at the coolant inlet is again measured so that at the step S the measured coolant pressure is memorized. The coolant pressure is then compared at the step T to determine if the motor has been trimmed down sufficient so as to bring the coolant inlet pressure above the minimum pressure A. If it has not, the device is returned to the step N and trimming down is continued.

If, on the other hand, the pressure at the coolant inlet now exceeds or is equal to the minimum pressure A, the velocity of the watercraft is sensed at the step U and memorized at V and this signal is transmitted to the differentiating step E so as to return to the automatic trim adjust mode.

It should be noted that if the coolant inlet pressure is below the minimum pressure at the step M, the computer moves to the step N to begin trimming down operation through the sequence just described.

Figure 11:
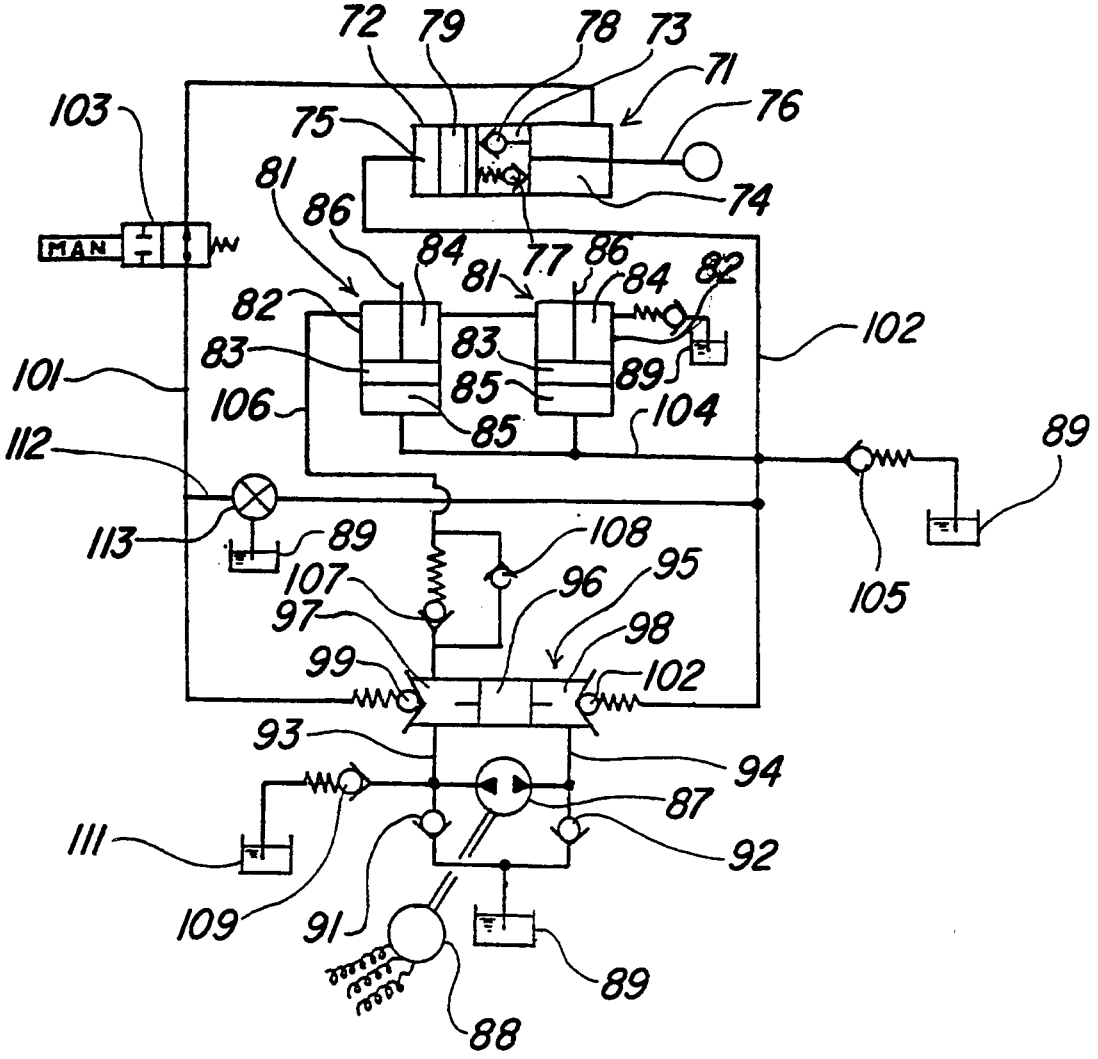
FIG. 11 is a partially schematic view showing a power trim unit constructed in accordance with another embodiment of the invention.

FIG. 11 illustrates another form of hydraulic tilt and trim unit that may be utilized in conjunction with the invention. In conjunction with this embodiment, there is provided a tilt fluid motor 71 having a cylinder 72 that is pivotally connected to the clamping bracket of the outboard motor. A piston 73 divides the cylinder 72 into an upper chamber 74 and a lower chamber 75. The piston 73 has affixed to it a piston rod 76 that extends through the upper end of the cylinder 72 and which is pivotally connected to the swivel bracket so that upon extension of the piston 73 the outboard motor will be tilted up.

As with the embodiment of FIG. 3, the piston 73 is provided with a pressure responsive absorber valve 77 that will open when an underwater obstacle is struck and which will permit the outboard motor to pop up. The motor may return to its position once the obstacle is cleared and a relief valve 78 extends through the piston 73 and is provided with a check valve so as to permit this operation. In addition, a floating piston 79 divides the lower chamber 75 into an upper and lower portion and acts as an abutment so as to hold the trim position of the outboard motor.

Trim control is primarily effected by means of a pair of trim fluid motors 81. The fluid motors 81 include cylinders 82 that are affixed to the clamping bracket of the outboard motor. Pistons 83 are received within the cylinders 82 and divide them into an upper chamber 84 and a lower chamber 85. The pistons have piston rods 86 that extend through the upper ends of the cylinders 82 through appropriate seals and which engage the swivel bracket during the trim range of movement of the outboard motor so as to adjust its trim position. This type of arrangement is well known in the art and it is believed that a further illustration of the relationship of the trim motors 81 and tilt motor 71 to the outboard motor or outboard drive is not necessary to those skilled in the art.

The tilt motor 71 and trim motors 81 are operated by a hydraulic circuit that includes a reversible fluid pump 87 that is driven by a reversible electric motor 88 which is adapted to be manually or automatically controlled by the systems as aforedescribed.

The pump has a first port that is adapted to draw fluid from a reservoir 89 through a check valve 91 when the pump operates in one direction and this port is the suction port. Alternatively, when the pump 87 is rotated in the opposite direction, fluid is drawn from the reservoir 89 through a conduit including a check valve 92. The ports are connected to conduits 93 and 94 which extend to opposite sides of a shuttle valve assembly, indicated generally by the reference numeral 95. The shuttle valve assembly 95 includes a shuttle piston 96 that forms a first chamber 97 that communicates with the conduit 93 and a second chamber 98 that communicates with the conduit 94.

A check valve 99 formed at one end of the chamber 97 provides selective communication with a conduit 101. In a similar manner, a check valve 102 at the end of the chamber 98 provides selective communication with a conduit 102. The conduit 101 extends to the tilt cylinder upper chamber 74 and a normally opened, manually operated valve 103 is provided in the conduit 101 for selectively blocking communication of the conduit 101 with the tilt cylinder chamber 74, for a reason to be described.

The conduit 102 extends to the chamber 75 on the lower side of the floating piston 79 for effecting tilting up operation, as will be described. In addition, a branch conduit 104 intersects the conduit 102 and extends to the lower chanters 85 of the trim cylinders 81. A pressure relief valve 105 is provided in the conduit 104 for pressure relief purposes, as will also be described.

A pair of parallel conduits interconnect the shuttle valve chamber 97 with a line 106 that extends to the upper side of the trim cylinders 81. A pressure responsive check valve 107 is provided in one of these conduits for controlling the flow to the chambers 84. A check valve 108 is provided in the other conduit and controls and return from the chambers 84 back to the shuttle valve chamber 97.

A pressure relief valve 109 is provided in the pump line 93 for pressure relief under tilt down, trim down conditions.

A passage 112 interconnects the conduits 101 and 102 and is provided with a manually operable valve 113 so as to permit manual tilt and trim of the outboard motor. The valve 113 has a connection to the reservoir 89 so as to permit fluid makeup in the system to compensate for the volume of the piston rods 76 and 86 during such manual tilt and trim operation.

The fluid system of the embodiment of FIG. 11 operates as follows. If either the operator or the computer selects trim up operation, the electric motor 88 is driven in a direction so as to cause the reversible pump 87 to pressurize the line 94 and the line 93 becomes a suction line. Pressurization of the line 94 causes the pressure in the shuttle valve chamber 98 to be elevated and shift the shuttle piston 96 to the left. This will cause a projection of the shuttle piston 96 to unseat the check valve 99. At the same time, the pressure increase in the chamber 98 causes the check valve 102 to unseat and the line 102 becomes pressurized. Hence, fluid pressure is delivered through the line 104 to the trim cylinder chambers 85 and through the line 102 to the tilt cylinder chamber 75 below the floating piston 72 so as to cause the trim cylinders 81 and tilt cylinders 71 to expand and pivot the outboard motor in an upward direction.

When the cylinders 71 and 81 are tilting up, fluid is returned to the return line 93 from the chamber 74 through the conduit 101 and from the chambers 85 of the trim cylinders 81 through the line 106, check valve 108 and shuttle valve chamber 97.

When the trim cylinders 81 reach the limit of their stroke, the outboard motor will still be tilted up as long as the motor 88 is energized since all fluid will then be diverted to the tilt cylinder chamber 75 to urge the floating piston 79 and piston 73 in an outward direction. When the limits of travel are reached, the relief valve 105 will open so as to prevent damage to the system if the motor 88 and pump 87 are not stopped.

Tilt or trim down operation is accomplished by operating the motor 85 so that the line 93 is pressurized and the line 94 acts as the return line. This pressurization of the line 93 causes the shuttle piston 96 to move to the right and its projection will unseat the check valve 102. At the same time, the pressure in the chamber 97 will be sufficient so as to unseat the check valve 99 and pressurize the line 101.

If the outboard motor has been tilted up sufficiently so that its swivel bracket no longer contacts the piston rods 86 of the trim cylinders 81, the check valve 107 will be maintained in a closed position due to the pressure required to open it and fluid will not be delivered to the line 106. Hence, the initial pressurization will be transmitted through the line 101 to the chamber 74 of the tilt cylinder 71 to effect tilt down operation. When the swivel bracket contacts the piston rods 86, a further pressure rise will occur in the line 101 and shuttle chamber 97 and this will cause the check valve 107 to open and permit trim down operation of the outboard motor.

During the tilt and trim down operation, fluid is returned from the tilt cylinder chamber 75 through the line 102 and from the trim cylinder chambers 85 through the lines 104 and 102.

When the respective pistons reach the lower limit of their stroke, the check valve 109 will open to provide pressure relief if the electric motor 88 is not stopped.

Manual tilt and trim operation is possible without fluid restriction by opening the manual valve 113 in the line 112, as should be apparent to those skilled in the art. If it is desired to move the outboard motor down manually through the opening of the valve 113 and the trim pistons have their piston rods 86 extended, the check valve 107 will open to permit fluid to be drawn into the chambers 84 above the pistons 83 from the reservoir 89.

During periods when the outboard motor is not in use or in storage for considerable periods of time, it is desirable to tilt the outboard motor up and also to bring the trim cylinders 81 to the lower limits of their stroke so that their piston rods 86 will not be exposed wherein they might become corroded or encrusted with barnacles or the like. To do this, the motor is first tilted up by operating the electric motor 88 and pump 87 so as to pressurize the line 102, in the manner previously described. However, this will leave the trim cylinders 81 at the outer ends of their stroke. In order to return them, the manual valve 103 is closed and the pump 87 is reversed so that the line 93 will be pressurized. No fluid can flow through the line 101 since the line 103 will be closed but fluid may flow past the check valve 107 through the line 106 to the upper chambers 84 of the trim cylinders 81 so as to retract the pistons 83.

It should be understood that the embodiments of FIGS. 3 and 11 are exemplary of only two types of hydraulic arrangements that may be operated by the computers constructed in accordance with this invention in order to practice the invention. Any of the other known types of hydraulic tilt and trim devices may be employed in connection with the invention. In addition, the invention may be practiced with mechanically operated tilt and trim units such as are shown in FIG. 12.

Figure 12:
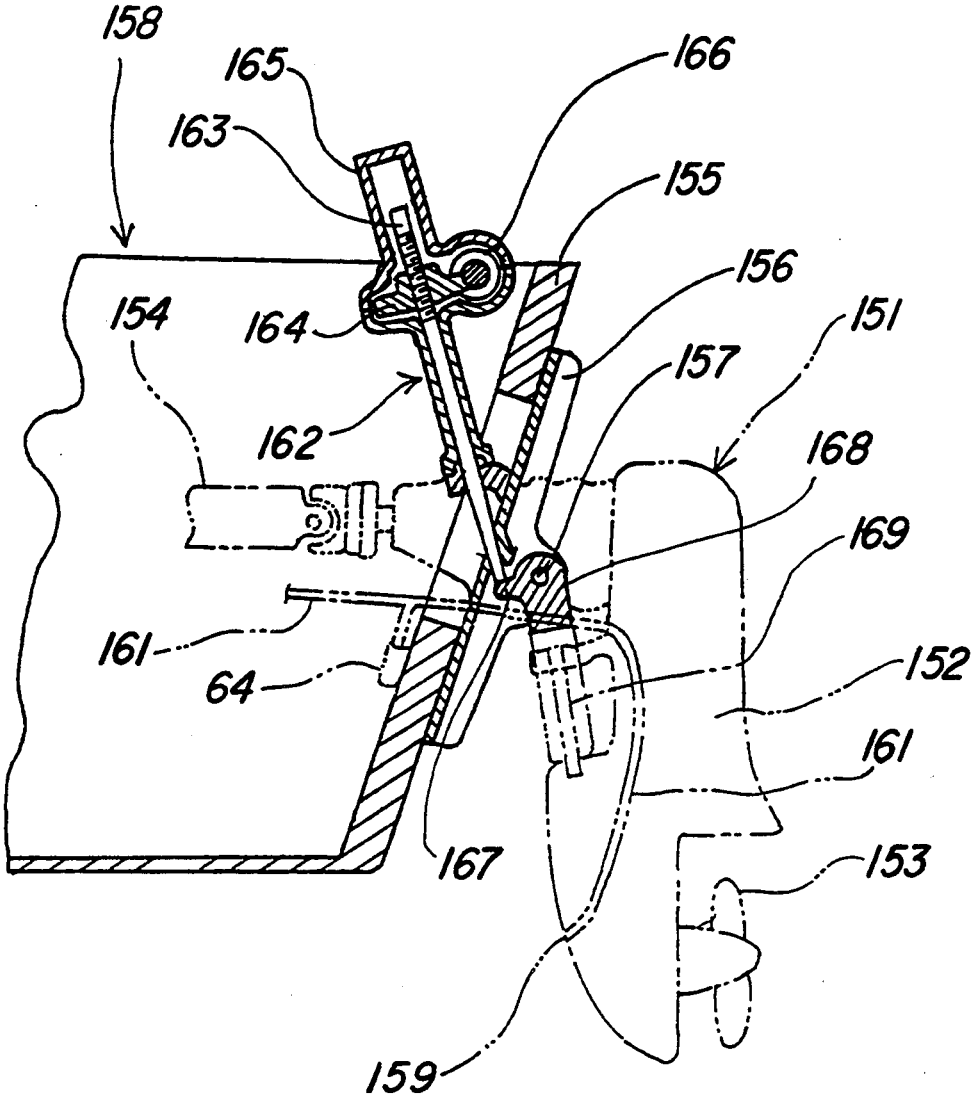
FIG. 12 is a side elevational view, with portions broken away and other portions shown in section, of a still further embodiment of the invention.

Referring now to FIG. 12, an outboard drive of an inboard/outboard drive arrangement is identified generally by the reference numeral 151. As has already been noted, the invention may be employed in conjunction with such outboard drives as well as outboard motors. The outboard drive 151 includes a housing assembly 152 that rotatably journals a propeller 153 which may be driven through a forward, reverse, neutral transmission of a known type. Power is transmitted to the outboard drive 151 from an inboard mounted engine via a drive shaft 154.

The outboard drive 151 is attached to a transom 155 of an associated watercraft by means of a supporting plate 156. The outboard drive 151 is pivotally supported on the plate 156 by means of a horizontally disposed pivot pin 157 for tilting movement of the outboard drive 151 about the axis defined by the pin 157.

Figure 10:
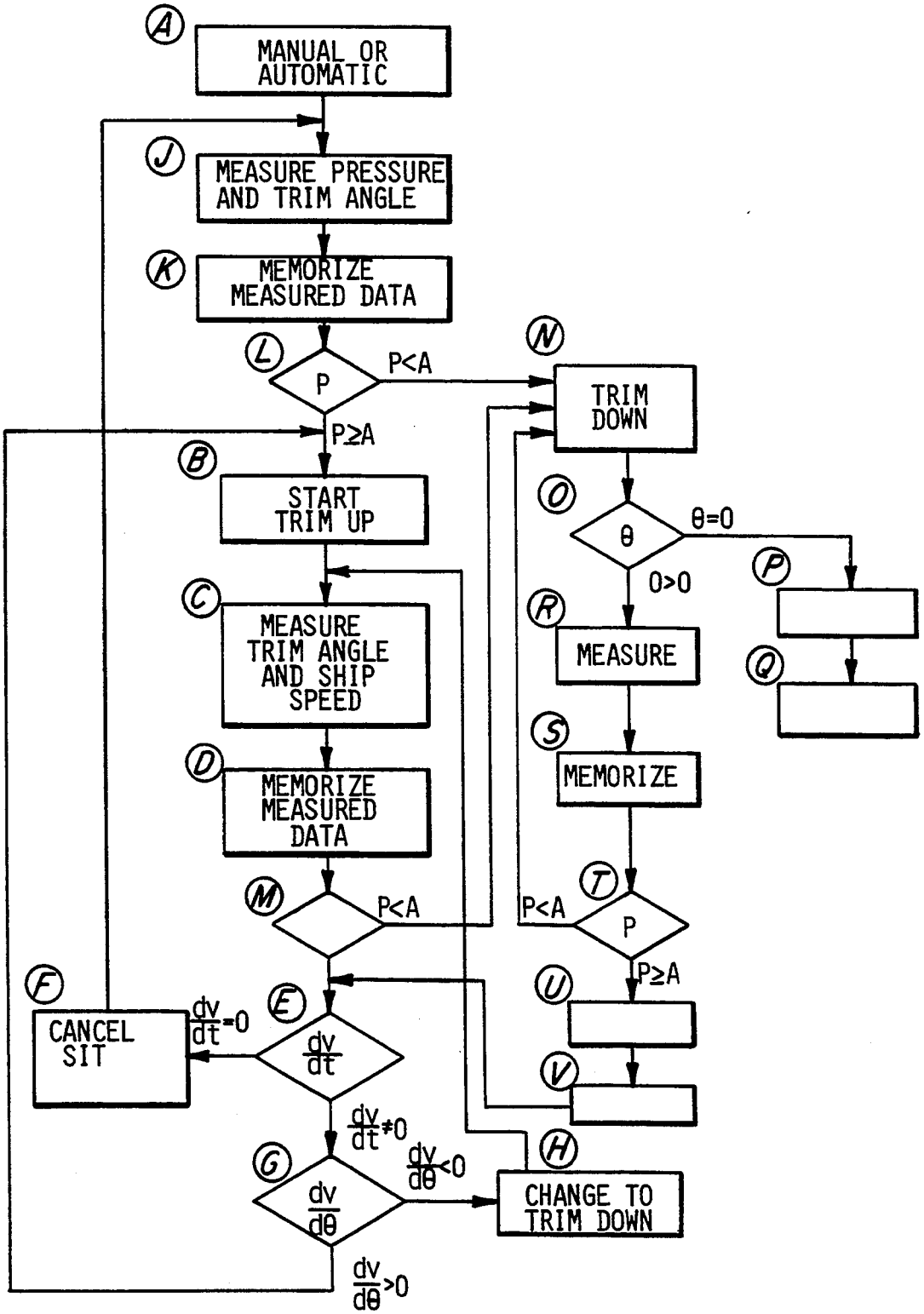
FIG. 10 is a block diagram showing the logic of the embodiment of FIG. 9.

Cooling water for the engine which is mounted in the hull of the watercraft, which hull is indicated generally by the reference numeral 158, is provided from an inlet opening 159 formed in the front portion of the lower part of the busing 152. A passage 161 extends through the outboard drive unit 151 and communicates with a conduit 161 for delivering coolant to the engine. If utilized in conjunction with the embodiment of FIGS. 9 and 10, the coolant inlet pressure sensor 64 may be mounted inboard of the transom 155 in communication with the conduit 161.

The tilt or trim position of the outboard drive 151 is controlled by a mechanical actuator, indicated generally by the reference numeral 162. The mechanical actuator 162 includes a rod 163 that has a male thread that is received within a female thread formed in a worm wheel 164. The gear 164 and rod 163 are supported within a housing 165. A worm gear 166 meshes with the worm wheel 164 and is driven by a reversible electric motor to effect reciprocation of the rod 163.

The lower end of the rod 163 bears against an extension 167 of a swivel bracket 168. The swivel bracket 168 is, as aforenoted, pivotally connected to the transom bracket 156 by the pivot pin 159. The outboard drive housing 152 is, in turn, supported for steering movement by means of a steering shaft 169 that is journaled within the swivel bracket 168 for steering of the outboard drive housing 152 in a known manner.

The motor which drives the gear 166 can be operated either manually or automatically by means of the computer systems which have been previously described. In addition, various other types of mechanical devices may be employed for operating the trim condition of the outboard drive or outboard motor.

The foregoing description is only of preferred embodiments of the invention and various other changes and modifications may be made without departing from the spirit and scope of the invention, as defined by the appended claims.

We claim:

1. In a watercraft comprising a hull, a propulsion unit adapted to be submerged in the water for propelling said hull, means for mounting said propulsion unit upon said hull for pivotal movement about a generally horizontally extending trim axis for adjusting the trim angle of said propulsion unit, power means for pivoting said propulsion unit about said trim axis for adjusting said propulsion unit trim angle, the improvement comprising automatic control means for controlling said power means to control the trim angle to achieve maximum watercraft speed for a given speed of said propulsion unit comprising means for sensing a rate of change in velocity of the watercraft, said automatic control means being operative between manual position wherein manual trim control by said power means can be effective and an automatic position for automatic control, said control means being effective upon initial activation to said automatic control position and regardless of speed or trim condition for initially operating said power means to effect full trim down of said propulsion unit and thereafter operating said power means for incrementally increasing said trim angle in response to a sensed rate of change of velocity to optimize the velocity of the watercraft for a given propulsion unit speed.

2. In a watercraft as set forth in claim 1 wherein the trim up is continued until the speed of the watercraft no longer increases and then trim down is effected until the speed of the watercraft no longer increases.

3. In a watercraft as set forth in claim 1 wherein the means for sensing a rate of change in velocity performs a differentiating function for determining the change in velocity with respect to time.

4. In a watercraft as set forth in claim 1 wherein the means for sensing the rate of change of velocity senses the velocity at different time intervals and provides a comparison therebetween.

5. In a watercraft as set forth in claim 1 further including means for sensing the trim angle and means for providing a signal to the means for controlling the power means from the trim angle sensing means.

6. In a watercraft as set forth in claim 1 further including means for sensing the rate of change of the trim angle, the means for controlling the power means receiving a signal from the means for sensing the rate of change of the trim angle.

7. In a watercraft comprising a hull, a propulsion unit adapted to be submerged in the water for propelling said hull, a cooling water inlet in said propulsion unit, means for sensing the pressure of the water at said cooling water inlet, means for mounting said propulsion unit upon said hull for pivotal movement about a generally horizontally extending trim axis for adjusting the trim angle of said propulsion unit, power means for pivoting said propulsion unit about said trim axis for adjusting said propulsion unit trim angle, the improvement comprising means for controlling said power means to maintain the appropriate trim angle for all running conditions comprising means for sensing a rate of change in velocity, means for operating said power means for adjusting said trim angle in response to a sensed change in velocity, and means for operating said power unit for trimming down said propulsion unit when the water pressure at said coolant water inlet falls below a predetermined value.

8. A method of trimming a watercraft comprising a hull, a propulsion unit adapted to be submerged in the water for propelling the hull, a cooling water inlet formed in the propulsion, means for mounting the propulsion unit upon the hull for pivotal movement a generally horizontally extending trim axis for adjusting the trim angle of the propulsion unit, power means for pivoting said propulsion unit about the trim axis for adjusting the propulsion unit trim angle, said method comprising controlling the power means to maintain the appropriate trim angle for all running conditions comprising the steps of measuring a change of velocity, operating the power means for adjusting the trim angle in response to a measured change of velocity, sensing the pressure of water at the cooling water inlet, and trimming down the propulsion unit when the water pressure falls below a predetermined value.

9. A position control system for a transom-mounted marine drive unit driven by a water-cooled engine, said system comprising:

(a) means for mounting the drive unit to the boat transom for movement of the drive unit between raised and lowered positions relative to the boat transom;

(b) fluid power means for moving the drive unit to and maintaining the same in a position at or between said raised and lowered positions;

(c) sensor means for sensing an undesirable operating condition in the drive unit and for generating a signal indicative of said undesirable operating condition, said sensor means including an engine temperature sensor, an engine cooling water pressure sensor, and an engine speed sensor;

(d) Means responsive to said signal for actuating fluid power means to move the drive unit to a lower portion.

10. A position control system for a transom-mounted outboard boat motor including a water-cooled engine, said system comprising mounting means for supporting the outboard motor aft of the boat transom, said mounting means including a first portion attachable to a boat transom and a second portion adapted to support the outboard motor; means for moving said second portion relative to said first portion to move the outboard motor between raised and lowered positions relative to the boat transom; sensor means including an engine cooling water pressure sensor and an engine speed sensor for sensing an undesirable operating condition in the outboard motor and for generating a signal indicative of said undesirable operating condition; and means responsive to said signal for actuating said moving means to move the outboard motor to a lower position.

* * * * *